US005901433A

United States Patent [19]

Moon et al.

[11] Patent Number: 5,901,433

[45] Date of Patent: May 11, 1999

[54] CYLINDRICAL COIL WINDING STRUCTURE OF FLYBACK TRANSFORMER

[75] Inventors: Myoung-Lib Moon, Seoul; Jong-Dae Kim; Sung-Hwan Jung, both of Jeonrabuk-Do; Ha-Eun Nam, Seoul, all of Rep. of Korea

[73] Assignee: Daewoo Electronics Co., Ltd., Seoul, Rep. of Korea

[21] Appl. No.: 08/745,418

[22] Filed: Nov. 12, 1996

[30] Foreign Application Priority Data

Nov. 14, 1995 [KR] Rep. of Korea ..... 95-41147
Nov. 30, 1995 [KR] Rep. of Korea ..... 95-69125

[51] Int. Cl.[6] ..... H01F 7/06

[52] U.S. Cl. ..... 29/606

[58] Field of Search ..... 336/206, 200, 336/174; 29/602.1

[56] References Cited

U.S. PATENT DOCUMENTS 3,726,004 4/1973 Holland et al. ..... 29/602

*Primary Examiner*—David A. Scherbel
*Assistant Examiner*—Benjamin M. Halpern
*Attorney, Agent, or Firm*—Smith, Gambrell & Russell, LLP; Beveridge, Degrandi, Weilacher & Young Intellectual Property Group

[57] ABSTRACT

A cylindrical coil winding structure of a flyback transformer is disclosed, which comprises a cylindrical winding member and a magnetizable core inserted into the cylindrical winding member. The cylindrical winding member includes a cylindrical insulator sheet and a conductor coil pattern formed on the outer surface thereof. A manufacturing process of the cylindrical flexible coil winding structure is also disclosed.

15 Claims, 4 Drawing Sheets

CYLINDRICAL COIL WINDING STRUCTURE OF FLYBACK TRANSFORMER

BACKGROUND OF THE INVENTION

1. Field of the Invention

The present invention relates to a coil winding structure of a transformer, and more particularly, to a cylindrical coil winding structure of a flyback transformer for applying high-voltage current to a cathode-ray tube.

2. Description of the Prior Art

Generally, a cathode-ray tube includes an electron gun emitting a thermal electron beam and a photosensitive screen producing desired colors and images by the emitted electron beam. The photosensitive screen is coated with a combination of R, G and B type fluorescent materials. Also the cathode-ray tube is provided with a deflection coil, a focusing coil and an accelerating coil, etc., for controlling the emitted electron beam.

Typically, the cathode-ray tube requires a high-voltage of 25,000 V or so for deflecting and focusing the electron beam, and this high voltage current is generated by a flyback transformer and applied to the cathode-ray tube.

FIG. 1 is a perspective view illustrating an exploded state of a conventional flyback transformer, which will be described below.

As illustrated in FIG. 1, the conventional flyback transformer includes a casing 10 having a through-hole 12, a cylindrical secondary coil assembly 30 inside the casing 10, a cylindrical primary coil assembly 20 inserted into the secondary coil assembly 30, a magnetizable core 40 inserted into the primary coil assembly 20, an anode cap 14 attached to the secondary coil assembly 30, a cover 50 for the casing 10, and a condenser 52 inside the cover 50, etc.

The primary and secondary coil assemblies 20, 30 respectively consist of an insulating bobbin 24, 34 and primary and secondary coil windings 22, 32 around the bobbins 24, 34. All turns of the coil windings 22, 32 are insulated from each other.

Voltage applied to the flyback transformer is rectified by the condenser 52, flows to the primary coil assembly 20, and consequently to the primary coil winding 22.

The voltage applied to the primary coil winding 22, that is, a primary voltage, provides a large secondary voltage by mutual induction effect. As is well known, the value of the secondary voltage is determined depending on the ratio of the number of turns of the secondary coil winding 32 to that of the primary winding 22. Thereafter, the induced secondary voltage is applied through the anode cap 14 to the cathode-ray tube and then functions by emitting, accelerating, and focusing the electron beam.

In the above-described conventional flyback transformer, however, achieving uniformity in the characteristics thereof is not easy. Namely, in the coil winding process, the adjacent coil turns are very likely to overlap or separate from each other. Therefore, all of those problems lead to variation or fluctuation in the characteristics of the flyback transformer, consequently resulting in poor high voltage regulation thereof.

Furthermore, the demand for large sized cathode-ray tubes has increased, and therefore various devices for supplying voltage to the cathode-ray tube, especially the flyback transformer which requires a greater number of turns in the coil windings, has lead to a resultant increase in the overall size of the flyback transformer.

SUMMARY OF THE INVENTION

To solve the above problems, an object of the invention is to provide a new cylindrical coil winding structure of a flyback transformer for achieving uniformity in the characteristics of the flyback transformer and also the compactness thereof.

Another object of the invention is to provide a process for manufacturing the cylindrical coil winding structure of the flyback transformer.

To achieve the object of the invention, there is provided a process for manufacturing a cylindrical coil winding structure of a flyback transformer, which comprises (a) applying a conductive material to the outer surface of a cylindrical insulator sheet to thereby form a conductive layer thereon; (b) coating a resistor on the surface of the conductive layer in a coil pattern; (c) removing the conductive layer except for the resistor-coated portion thereof to form a conductor coil pattern, thereby providing a cylindrical winding member including the cylindrical insulator sheet and the conductor coil pattern formed on the outer surface thereof; and (d) inserting a magnetizable core into the cylindrical winding member.

Preferably, the cylindrical insulator sheet has a thickness of less than about 35 microns and preferably has a thickness of from 20 to 30 microns, and may be made from insulating materials such as polyimide or polyester, etc.

The conductive layer is preferred to have a thickness of from several to about 100 microns, preferably of from about 25 to 75 microns, and may be made from metallic materials such as copper or aluminum, etc.

The applying step of (a) is preferably carried out by electroplating, electroless-plating, or vapor-depositing the conductive material.

The applying step of (a) may be carried out by forming a seed layer on the outer surface of the cylindrical insulator sheet by using an RF sputtering technique, and applying the conductive material to the surface of the seed layer to thereby form the conductive layer. Metallic materials such as chromium or nickel, etc., may be employed in forming the seed layer.

The removing step of (c) is carried out by etching a portion of the conductive layer which is not coated by the resistor.

Also, according to the invention, there is provided a cylindrical coil winding structure of a flyback transformer, which comprises a cylindrical winding member and a magnetizable core inserted into the cylindrical winding member. The cylindrical winding member includes a cylindrical insulator sheet and a conductor coil pattern formed on the outer surface thereof.

The cylindrical coil winding structure may be provided with a plurality of cylindrical winding members, thereby accomplishing a greater number of turns of coil windings. The cylindrical winding members have a series of different diameters and are multi-layered in a concentric manner. The cylindrical winding members are electrically connected with each other.

BRIEF DESCRIPTION OF THE DRAWINGS

The above, other features and advantages of the invention will be apparent from the following detailed description of the preferred embodiments of the invention in conjunction with the following drawings in which.

DETAILED DESCRIPTION OF THE PREFERRED EMBODIMENT

Hereinafter, the invention will be described in further detail by way of preferred embodiments with reference to the accompanying drawings.

Figure 2A:
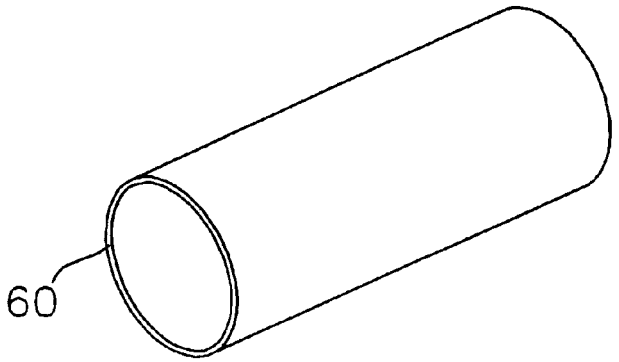
FIGS. 2A to 2E are schematic views illustrating sequentially the process steps of the invention.
Figure 2B:
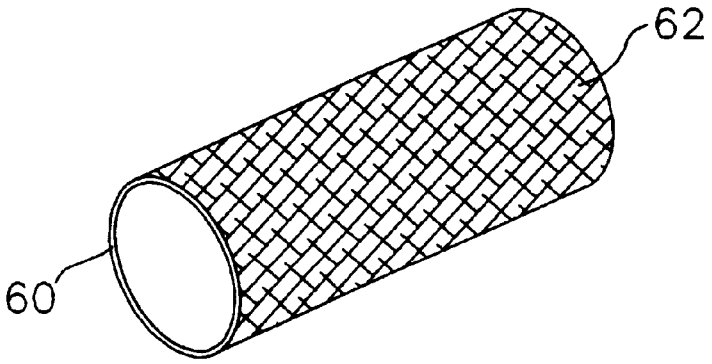
Figure 2C:
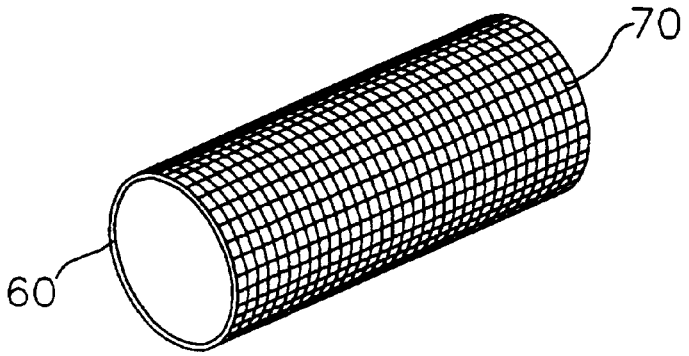

FIGS. 2A to 2C illustrate schematically the first step of the process of the invention, in that a conductive material is applied to the outer surface of a cylindrical insulator sheet to form a conductive layer thereon.

In the first step of the invention, as illustrated in FIG. 2B, a seed layer 62 is formed on the outer surface of the cylindrical insulator sheet 60 illustrated in FIG. 2A, and then, as illustrated in FIG. 2C, the conductive material is applied over the seed layer 62 to thereby form the conductive layer 70 on the outer surface of the cylindrical insulator sheet 60.

Preferably, the cylindrical insulator sheet 60 may be made from an insulating substance such as polyimide and polyester, etc., which have good characteristics in heat-resistance and electric insulation. The cylindrical insulator sheet 60 is preferred to be sufficiently thin enough to preserve its flexibility, and more preferably has a thickness of less than about 35 microns.

The conductive layer 70 may be a metallic material such as copper or aluminum, which has good characteristics in electric conductivity and adhesiveness to the cylindrical insulator sheet 60. The conductive layer 70 of copper or aluminum may be formed on the cylindrical insulator sheet 60 by using electroplating, electroless plating, vapor deposition or RF sputtering techniques, etc., on a case by case basis.

Metallic materials such as copper or aluminum are known not to have a very good adhesiveness to the polyimide or polyester of the cylindrical insulator sheet 60. Therefore, as one preferred embodiment for easily forming the conductive layer 70 of copper or aluminum on the cylindrical insulator sheet 60, as illustrated in FIG. 2B, the seed layer 62 may be formed on the outer surface of the sheet 60 by using RF sputtering technique, etc., and then, as illustrated in FIG. 2C, the uniform conductive layer 70 may be applied over the seed layer.

Nickel, chromium, etc., may be preferably used as materials for the seed layer 62.

Of course, without forming the seed layer 62, the conductive layer 70 of copper or aluminum may be applied to the outer surface of the cylindrical insulator sheet 60 by using vapor deposition or RP sputtering techniques, etc.

Preferably, the conductive layer 70 has a thickness of from several to about 100 microns, more preferably of from about 25 to 75 microns for preserving the electric conductivity and also the flexibility thereof.

Figure 2D:
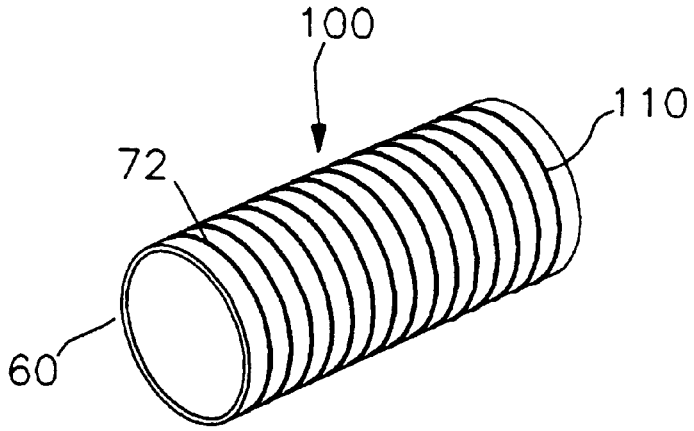

FIG. 2D illustrates schematically the second and third steps of the invention, which will be described in detail below.

In accordance with the second step of the invention, a resistor 72 is coated over the surface of the conductor layer 70 in a coil pattern, as illustrated in FIG. 2D. Thereafter, in the third step of the invention, the conductor layer 70 is removed from the cylindrical insulator sheet 60 except for the portion coated with the resistor 72 to thereby form a conductor coil pattern 110 around the cylindrical insulator sheet 60, similarly as illustrated in FIG. 2D. In FIG. 2D, reference numeral 100 denotes generally a cylindrical winding member, which includes the cylindrical insulator sheet 60 and the conductor coil pattern 110 formed along around the outer surface thereof.

The coating of the resistor 72 may be carried out by conventional procedures, namely, by using a predetermined sized nozzle under consideration of the width and interspace of conductor lines according to a designed conductor coil pattern.

The removal of the non-coated portion from the conductive layer 70 may be carried out by etching, for example, by using an aqueous solution of ferric oxide which is able to etch selectively the conductive layer 70 of copper but not the cylindrical insulator sheet 60.

Therefore, the invention could achieve a conductor coil pattern consisting of a very fine conductor line with variation of the size of the resistor nozzle.

Figure 2E:
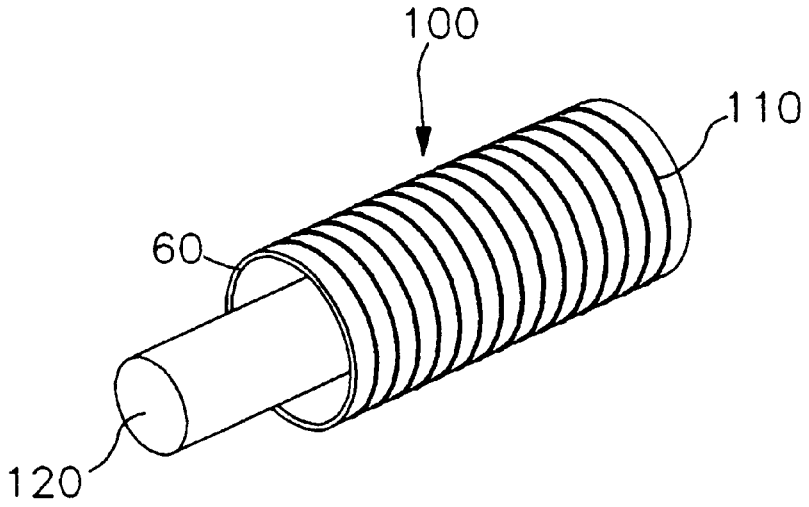

FIG. 2E illustrates schematically the final fourth step of the invention, in which the cylindrical coil winding structure of the invention is completed by inserting a magnetizable core 120 into the cylindrical winding member 100.

As illustrated in FIG. 2E, the cylindrical coil winding structure of the invention comprises basically the cylindrical winding member 100 and the magnetizable core 120 inserted thereto. The cylindrical winding member 100 includes the cylindrical insulator sheet 60 and the conductor coil pattern 100 formed along around the outer surface of the sheet 60.

Figure 3:
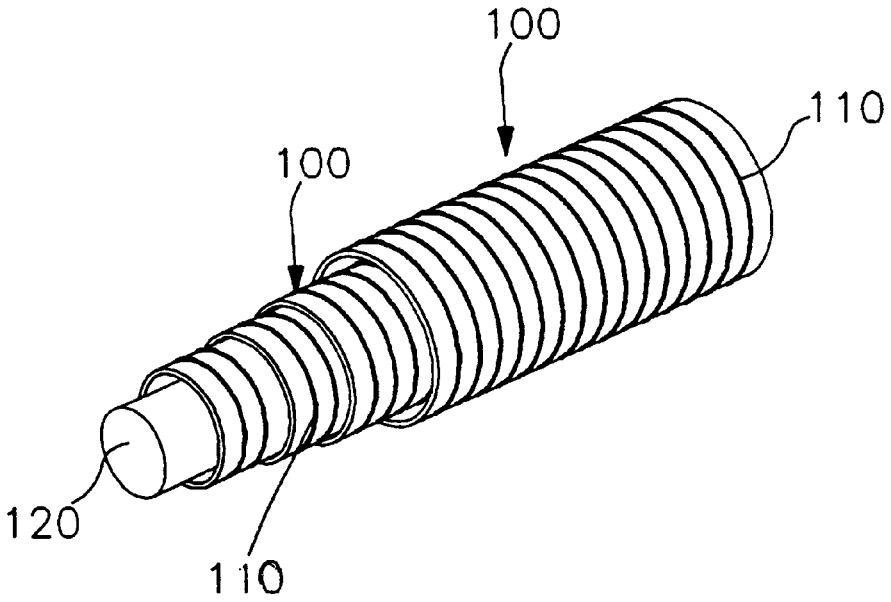
FIG. 3 is a perspective view illustrating another embodiment of the invention.

FIG. 3 illustrates schematically another embodiment of the cylindrical coil winding structure, which includes a plurality of the cylindrical winding members 100 and the magnetizable core 120.

As illustrated in FIG. 3, the cylindrical coil winding structure is provided with a plurality of cylindrical winding members 100 to thereby accomplish a greater number of turns of coil windings. The cylindrical winding members have a series of different diameters and are multi-layered in a concentric manner. Any persons skilled in the art could understand that the conductor coil patterns of the cylindrical winding members may be electrically connected with each other, for example, by providing lead wires attached respectively to the lead terminal and the end terminal of the individual conductor coil pattern, and then effectively connecting the lead wires.

Figure 1:
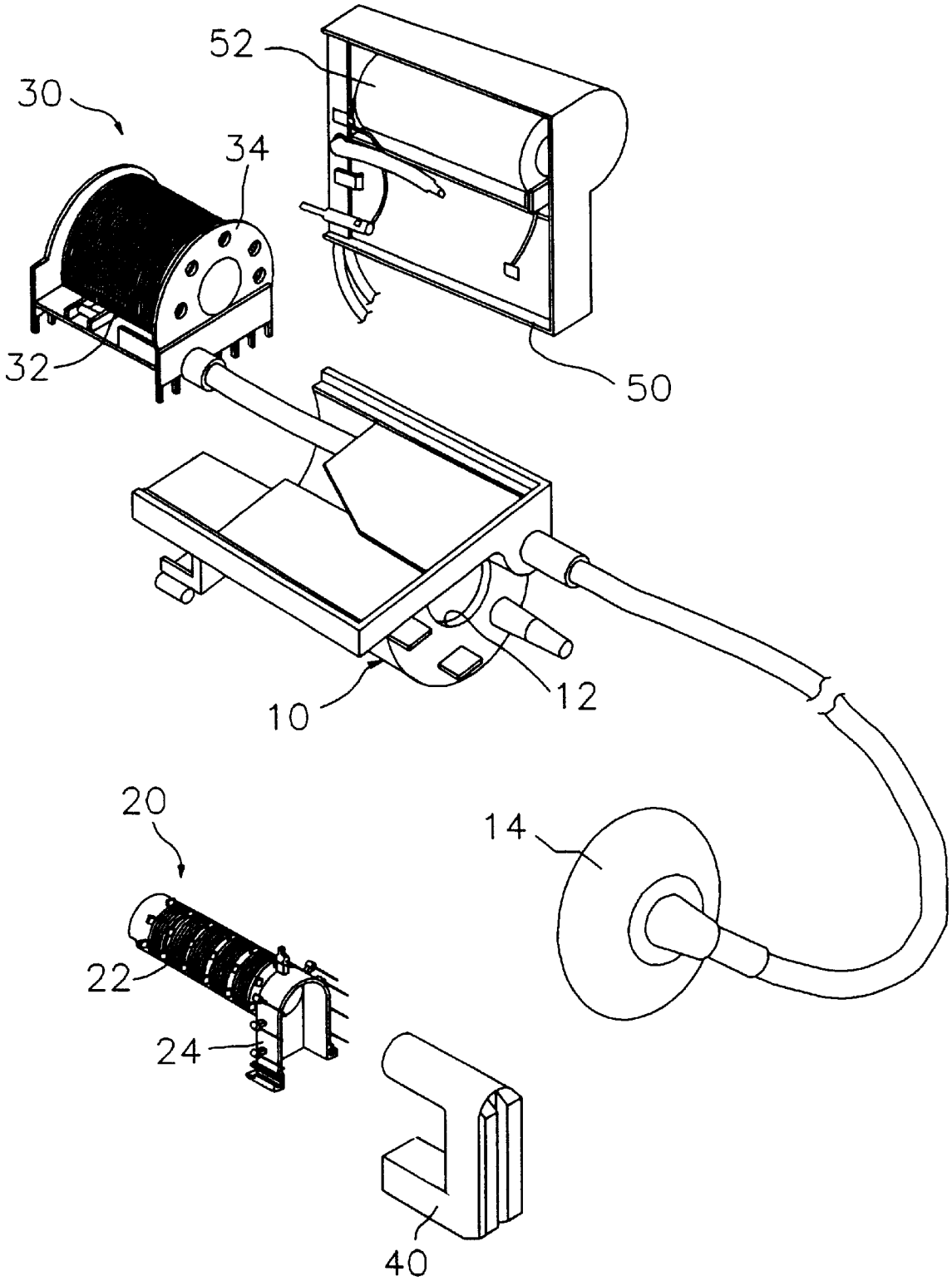
FIG. 1 PRIOR ART
FIG. 1 is a perspective view illustrating an exploded state of a conventional flyback transformer.

As clearly described above, the cylindrical coil winding structure of a flyback transformer (FBT) according to the invention does not need large bobbins 24, 34 as illustrated in FIG. 1 of the prior art because the number of turns of the coil windings can be considerably increased without increasing the overall size of the FBT, even though the FBT requires a greater number of turns of coil windings.

Also, the cylindrical coil winding structure of the invention includes a plurality of the cylindrical winding members 100, which are regularly layered in a concentric manner. Furthermore, the cylindrical winding members 100 include the conductor coil pattern 110 of which the conductor line is very fine and uniformly formed. Therefore, all of these features naturally result in uniformity in the functional characteristics of FBT.

While the present invention has been particularly shown and described with reference to preferred embodiments thereof, it will be understood by those skilled in the art that various changes in form and details may be effected therein without departing from the spirit and scope of the invention as defined by the appended claims.

What is claimed is:

1. A process for manufacturing a cylindrical coil winding structure of a flyback transformer comprising the steps of:

(a) applying a conductive material to an outer surface of a cylindrical insulator sheet to thereby form a conductive layer on the cylindrical insulator sheet;

(b) applying a resistor material directly onto a surface of the conductive layer in a coil pattern to form a coiled resistor-coated portion, wherein adjacent windings of the coil pattern do not contact one another;

(c) removing the conductive layer except for the conductive material located beneath the coiled resistor-coated portion to form a conductor coil pattern, thereby providing a cylindrical winding member including the cylindrical insulator sheet and the conductor coil pattern formed on the outer surface of the cylindrical insulator sheet; and (d) inserting a magnetizable core into the cylindrical winding member.

2. The process as claimed in claim 1, wherein the cylindrical insulator sheet has a thickness of less than 35 microns.

3. The process as claimed in claim 1, wherein the cylindrical insulator sheet is made from a material selected from a group consisting of polyimide and polyester.

4. The process as claimed in claim 1, wherein the conductive layer has a thickness of less than 100 microns.

5. The process as claimed in claim 1, wherein the conductive material is selected from a group consisting of copper and aluminum.

6. The process as claimed in claim 1, wherein the applying step of (a) is carried out by electro-plating the conductive material.

7. The process as claimed in claim 1, wherein the applying step of (a) is carried out by electroless-plating the conductive material.

8. The process as claimed in claim 1, wherein the applying step of (a) is carried out by vapor-depositing the conductive material.

9. The process as claimed in claim 1, wherein the applying step of (a) is carried out by forming a seed layer on the outer surface of the cylindrical insulator sheet, and applying the conductive material to a surface of the seed layer to thereby form the conductive layer.

10. The process as claimed in claim 9, wherein the seed layer is formed by RF sputtering.

11. The process as claimed in claim 9, wherein the seed layer is made from a material selected from a group consisting of chromium and nickel.

12. The process as claimed in claim 1, wherein the removing step of (c) is carried out by etching a portion of the conductive layer which is not coated by the resistor.

13. The process as claimed in claim 1, wherein the conductive layer has a thickness of from 25 to 75 microns.

14. The process as claimed in claim 1, wherein the resistor material is coated onto the surface of the conductive layer by spraying.

15. The process as claimed in claim 13, wherein the resistor material is sprayed through a nozzle.

* * * * *